United States Patent [19]

Shaver

[11] 4,189,988

[45] Feb. 26, 1980

[54] INSULATION AND VENTILATION SYSTEM FOR MOBILE HOMES

[76] Inventor: Noah Shaver, 32 W. Harvard St., Orlando, Fla. 32804

[21] Appl. No.: 869,537

[22] Filed: Jan. 16, 1978

[51] Int. Cl.[2] ..... F24F 7/02

[52] U.S. Cl. ..... 98/31; 52/199

[58] Field of Search ..... 98/31, 32, 42; 52/199, 52/218, 807; 428/119, 120; 113/116 Y; 29/155 R

[56] References Cited

U.S. PATENT DOCUMENTS

| | | | |
|---|---|---|---|
| 386,465 | 7/1888 | Haish | 52/299 |
| 1,995,213 | 3/1935 | Martin | 98/32 X |
| 2,889,763 | 6/1959 | Pine | 98/31 |
| 2,954,727 | 10/1960 | Katt et al. | 52/199 X |
| 2,990,038 | 6/1961 | Diamond | 29/155 R X |
| 3,086,323 | 4/1963 | Pine | 52/22 |
| 3,223,018 | 12/1965 | Tucker, Sr. | 98/31 |
| 3,940,896 | 3/1976 | Steel | 428/119 X |
| 3,984,961 | 10/1976 | Chieger et al. | 428/119 X |
| 4,032,689 | 6/1977 | Johnson et al. | 428/55 |

*Primary Examiner*—William E. Wayner
*Assistant Examiner*—William E. Tapolcai, Jr.
*Attorney, Agent, or Firm*—Duckworth, Hobby & Allen

[57] ABSTRACT

A system for use with a conventional building such as a mobile home having an existing roof includes a sheet having dimensions generally conforming to the roof with a central opening therein. A plurality of brace plates extend from the peripheral edge of the roof-sheet combination to the center opening, to hold the sheet in spaced relationship above the roof so as to define a void therebetween communicating with the central opening, and further defining peripheral openings permitting movement of a cooling fluid from the ambient into the void. Sliding and overlapping members are provided for closing the central and peripheral openings in order to define an insulating layer above the roof.

8 Claims, 3 Drawing Figures

INSULATION AND VENTILATION SYSTEM FOR MOBILE HOMES

BACKGROUND OF THE INVENTION

1. Field of the Invention

The present invention relates to insulating and ventilating structures for static structures such as buildings, and in particular, relates to systems designed to provide alternate ventilation and insulation for mobile homes.

2. Description of the Prior Art

A great deal of interest has been generated in developing techniques for increasing the heating and cooling efficiency of static structures such as buildings, mobile homes, and the like. A common technique for cooling such structures is to provide an outer "skin" or sheet above the roof, the sheet being spaced from the roof so as to define a void therebetween. Means are conventionally provided for moving air through the void so as to cool the roof and thereby increase the cooling efficiency within the structure. Examples of prior art arrangements employing these techniques are shown in the following United States patents: U.S. Pat. No. 2,188,699 to Barron; U.S. Pat. No. 2,150,217 to Gettelman; U.S. Pat. No. 3,086,323 to Pine; U.S. Pat. No. 2,889,763 to Pine; and U.S. Pat. No. 2,852,109 to Pine.

Likewise, it is conventional to employ a spaced structure above the roof or ceiling of a building in order to define an insulating space, the space being closed off so as to prevent the movement of air. Once the sun strikes the outer shell, the air within the insulating space is heated, creating an insulating barrier to increase the insulating efficiency of the structure.

Because of their low cost nature, mobile homes have become extremely popular in recent years. These structures are characterized by thin metallic outer shells, and generally have low insulation and ventilation efficiency with respect to permanent dwellings constructed of other materials. Accordingly, it is desirable to provide a system for effecting the insulation, or ventilation, or both, of mobile homes and similar low-cost structures. However, to accomplish this end, the system must be relatively inexpensive in keeping with the overall low-cost nature of mobile homes. Further, the system must be easy to assembly and operate. Finally, it is extremely desirable that a single system provide means for both insulating and ventilating the roof of the mobile home, to increase flexibility of the overall system.

SUMMARY OF THE INVENTION

The present invention contemplates a system for use with a conventional building having an existing roof, and includes a sheet having dimensions generally conforming to the roof, the sheet having a central opening therein. Means are provided for holding the sheet in spaced relation above the roof so as to define a void there between, the sheet and the roof further defining peripheral openings permitting movement of a cooling fluid from the ambient into the void.

The holding means further includes means for substantially restricting flow of fluid through the peripheral openings in substantially parallel paths through the void and out of the central opening. Means are also provided for closing both the central and peripheral openings.

In a preferred embodiment, the sheet is flexible and the holding means includes means for conforming the sheet to any curvature or pitch of the roof. In a specific embodiment, this curvature conforming means comprises a holding means formed of a plurality of brace plates having lateral slots therein extending between the roof and the sheet, such that the bottom of the brace plate may curve about the roof, and the top thereof may make supporting engagement of the sheet, but in a manner which allows the sheet to conform to the curvature of the brace plate, and thus the roof of the building.

THE DRAWING

DESCRIPTION OF THE PREFERRED EMBODIMENT

A description of the preferred embodiment of the present invention will now be made with reference to FIGS. 1, 2 and 3.

Figure 1:
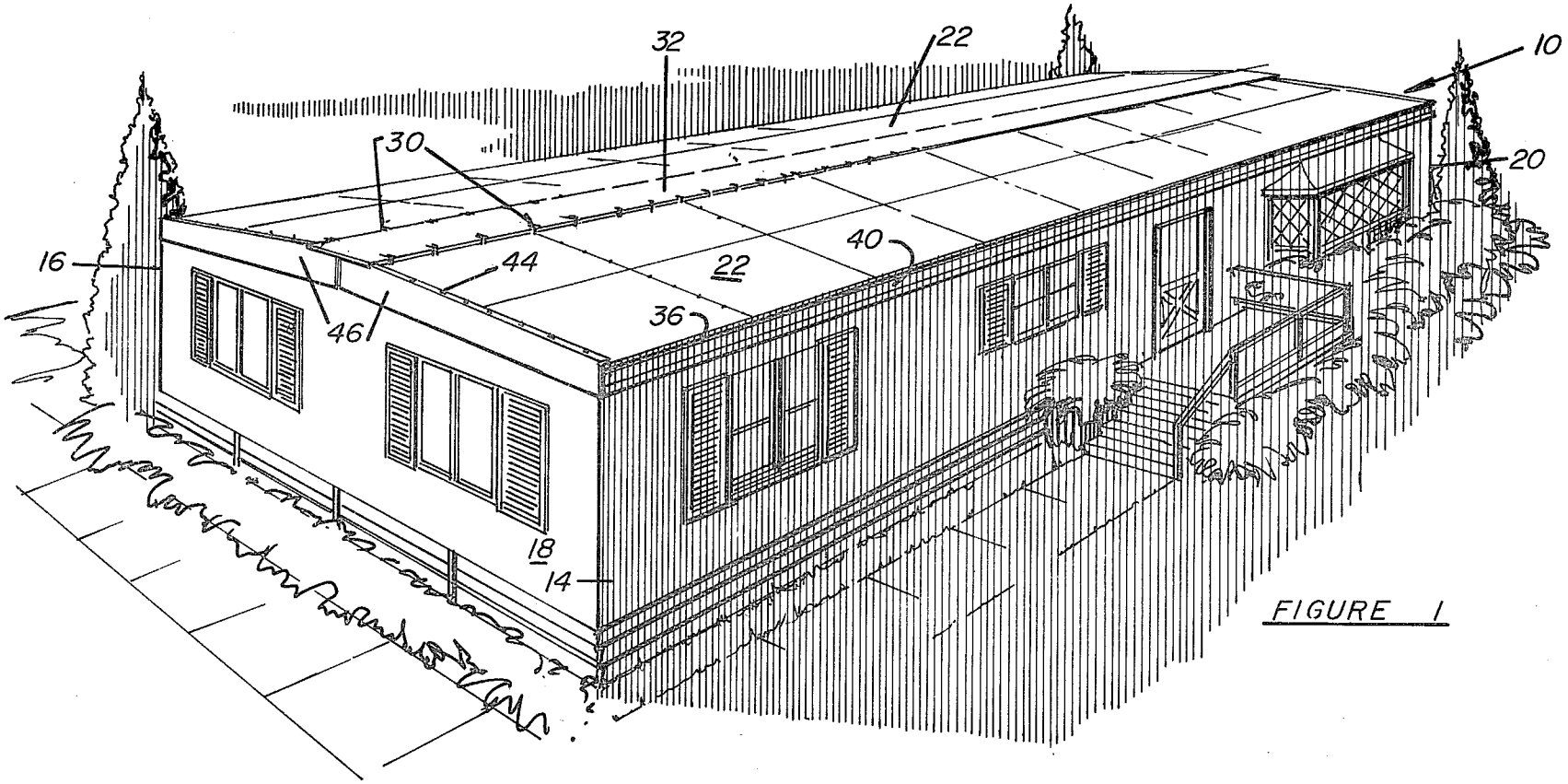
FIG. 1 is a perspective view of a mobile home employing the insulation and ventilation system of the present invention.
Figure 2:
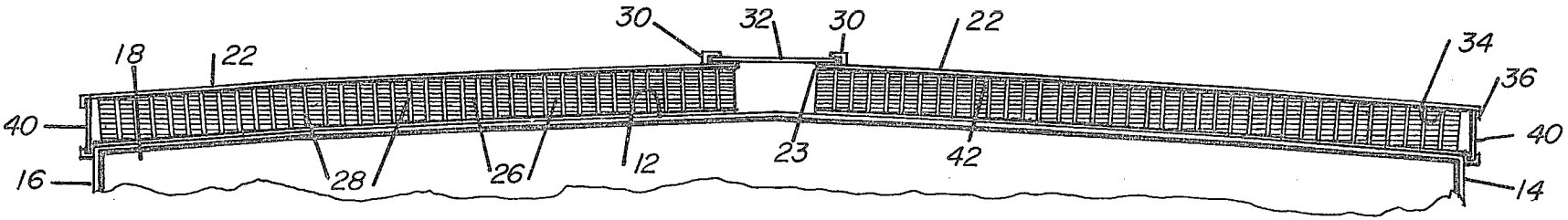
FIG. 2 is an end view of a portion of the mobile home shown in FIG. 1, with a portion of the system removed.

Noting FIGS. 1 and 2, there is shown a mobile home 10 having a roof 12, side walls 14, 16 and end walls 18 and 20. The mobile home 10 is of a conventional structure, in which the roof 12 may have a slight pitch and curvature thereto in order to allow rain to drain therefrom.

Figure 3:
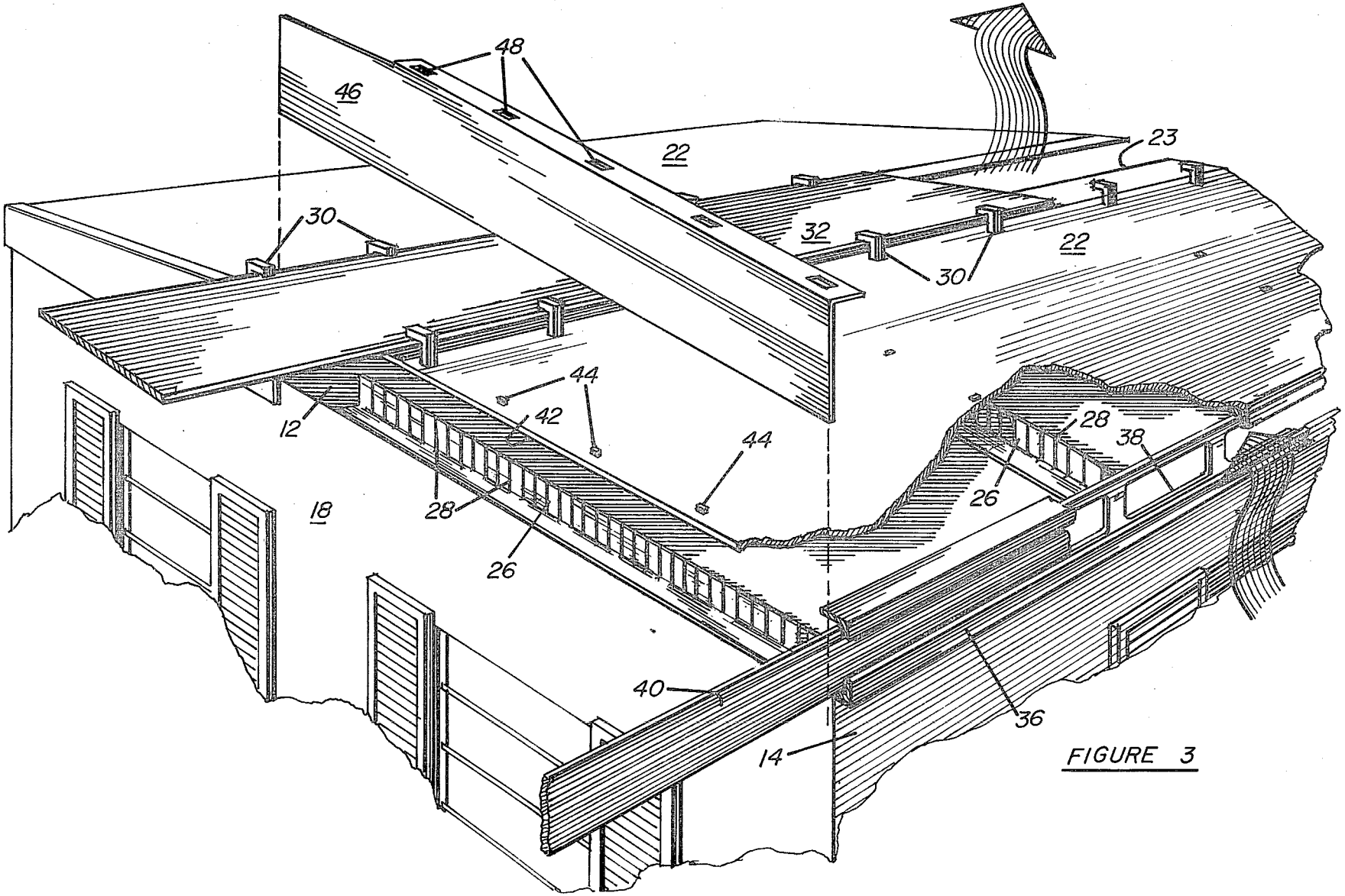
FIG. 3 is a perspective, exploded view of a portion of the structure shown in FIG. 1.

Reference is now made to FIGS. 1, 2 and 3. In accordance with the present invention, the mobile home 10 is provided with a flexible sheet 22, such as fiberglass, for example. Preferably, the sheet 22 is formed to two sides, each side defined by a plurality of section panels, all of the panels forming a central opening 23 extending down the middle of the mobile home between the end walls 18, 20 and parallel with the side walls 14, 16. The flexible sheet 22 is supported above the roof 12 so as to define a void therebetween.

The holding means for supporting the sheet 22 in this manner include a plurality of brace plates 26 extending between the sheet 22 and the roof 12, and substantially normal to the side walls 14, 16. Each brace plate 26 includes a plurality of lateral slots 28 therein extending between the roof 12 and the sheet 22, the brace plate thus forming a web which permits the brace plate to be spread at the top thereof to allow the sheet 22 to be curved in conformity with the curvature of the roof 12 (Note FIG. 3). The structure is further provided with a plurality of L-shaped brackets 30 attached to the sheet sections 22 on opposing sides of the central opening 23, the brackets forming a guide and locking arrangement for a central sliding member 32. The central sliding member 32 is adapted to slidingly engage the peripheral edge of the central opening 23 to thereby cover that opening.

As specifically shown in FIGS. 2 and 3, the mobile home 10 is further provided with a C-shaped bracket 36 at the peripheral edge along the side walls 14, 16. The bracket 36 includes a plurality of openings therethrough communicating with the peripheral opening 34 between the sheet 22 and the roof 12. The bracket 36 is dimensioned so as to receive a peripheral sliding member 40 which extends across and covers the openings 38 and thereby prevents the flow of air through the openings 38 and the peripheral openings 34 into the void between the sheet 22 and the roof 12.

Similar peripheral closures are included for the end peripheral openings 42 above the end walls 18, 20 of the mobile home 10. Noting FIG. 3, this closure means includes a plurality of pegs 44 extending from the peripheral edge of the sheet 22 adjacent to that peripheral opening 42. There is further provided an L-shaped member 46 having a plurality of holes 48 therein corresponding to the pegs 44, the member 46 being dimensioned so as to fit over the peripheral opening 42 above the end walls 18, 20.

The function of the system shown in FIGS. 1, 2 and 3 will now be described.

Noting FIG. 1, an insulation layer above the roof 12 may be created by sliding the central sliding member 32 over the central opening 23 to close that central opening. Likewise, the peripheral openings 34 and 42 may be closed by appropriate use of the peripheral sliding member 40 and the L-shaped member 46 to prevent the flow of air from the ambient through the corresponding peripheral openings 34 and 42 into the void between the sheet 22 and the roof 12, which layer is heated by the sun so as to create an insulating barrier for heat within the mobile home 10 during the winter months.

Conversely, the central and peripheral sliding members 32 and 40, and the L-shaped member 46 may be removed, thus allowing ambient air to flow through the respective peripheral openings into the void and out of the central opening 23. This flow of air cools the roof 12, while the sheet 22 prevents the sun's heat from directly striking the roof. The effect is to maintain the roof 12 at a cooler temperature, thus maintaining the interior of the mobile home 10 at a lower temperature.

It will, of course, be appreciated by those skilled in the art to which this invention pertains that other modifications can be made to the structure shown in the drawing and described above without departing from the spirit and scope of the present invention. For example, it may be feasible to dispose the central opening transversely across the roof between the long sides of the building 18, and with the brace plates 26 extending lengthwise between the two short sides of the building.

I claim:

1. A system for use with a conventional building having an existing roof, said system comprising:

a flexible sheet having dimensions generally conforming to said roof, said sheet including a central opening extending along said sheet parallel with a first edge of said roof;

means for conforming said sheet to the pitch of said roof and for holding said sheet in spaced relation above said roof so as to define a void therebetween communicating with said central opening, said sheet and said roof further defining peripheral openings permitting movement of a cooling fluid from the ambient into said void, said holding means including a plurality of brace plates between said roof and said sheet and normal to said first edge, each plate having plural slots therein extending from said sheet toward said roof;

said holding means further including means for substantially restricting flow of said fluid through said peripheral openings along substantially parallel paths through said void and out of said central opening;

means for closing said central opening; and means for closing said peripheral openings.

2. The system recited in claim 1 wherein said means for closing said central opening comprises:

a central sliding member for overlapping said central opening and engaging the periphery thereof; and means for locking said central sliding member in place over said central opening.

3. The system recited in claim 2 wherein said locking means comprises a plurality of substantially L-shaped brackets each extending from said sheet and engaging said sliding member.

4. The system recited in claim 3 wherein said means for closing said peripheral openings comprises:

a substantially C-shaped bracket means mounted at the periphery of said sheet and between said sheet and said roof, said bracket having openings therein communicating with said peripheral openings; and a peripheral sliding member for sliding through said bracket and closing said openings.

5. The system recited in claim 4 wherein said means for closing said peripheral openings comprises:

a plurality of pegs extending from the outer surface of said sheet at the peripheral edge thereof;

an L-shaped bracket member having a lengthwise dimension sufficient to cover at least a substantial portion of said peripheral openings, said bracket further including a plurality of holes therein for corresponding engagement with said pegs; whereby said bracket member laps over said portion of said peripheral openings to effect the closure thereof.

6. A system for use with a conventional building having an existing roof, said system comprising:

a sheet having dimensions generally conforming to said roof;

means for holding said sheet in spaced relation above said roof so as to define a void therebetween, said sheet and said roof further defining peripheral openings permitting movement of a cooling fluid from the ambient into said void;

said holding means including a plurality of brace plates extending between said roof and said sheet in a direction normal to a first edge of said roof, each brace plate including a plurality of lateral slots therein extending between said roof and said sheet, whereby said brace plates effect the conformity of said sheet to any curvature or pitch of said roof;

a bracket member mounted at the periphery of said sheet between said sheet and said roof, said bracket member having openings therein communicating with said peripheral openings; and a peripheral sliding member for sliding through said bracket and closing said bracket openings.

7. The system recited in claim 6 wherein said sheet includes a central opening therein, said system further comprising:

a central sliding member overlapping said central opening and engaging the periphery thereof; and means for locking said central sliding member in place over said central opening.

8. The system recited in claim 7 wherein said means for closing said peripheral openings further includes:

a plurality of pegs extending from the outer surface of said sheet at the peripheral edge thereof; and an L-shaped bracket member having a lengthwise dimension sufficient to cover at least a substantial portion of said peripheral openings, said bracket member further including a plurality of holes therein for corresponding engagement with said pegs, whereby said bracket member laps over said portion of said peripheral openings to effect the closure thereof.

* * * * *